United States Patent [19]

Kawamura et al.

[11] Patent Number: 4,921,410

[45] Date of Patent: May 1, 1990

[54] METHOD OF PRODUCING A COMPACT OF AMORPHOUS ALLOYS

[75] Inventors: Yoshihito Kawamura, Obu; Masashi Akai, Aichi; Makoto Takagi, Okazaki, all of Japan

[73] Assignee: Nippondenso Co., Ltd., Kariya, Japan

[21] Appl. No.: 225,215

[22] Filed: Jul. 28, 1988

[30] Foreign Application Priority Data

Jul. 29, 1987 [JP] Japan ..... 62-189803

[51] Int. Cl.[5] ..... G22F 7/00

[52] U.S. Cl. ..... 419/8; 419/23; 419/41; 75/246

[58] Field of Search ..... 419/8, 4, 69, 50, 25; 75/243, 122

[56] References Cited

U.S. PATENT DOCUMENTS

| | | | |
|---|---|---|---|
| 4,377,622 | 3/1983 | Liebermann | 75/229 |
| 4,594,104 | 6/1989 | Reybould | 75/243 |
| 4,668,591 | 5/1987 | Minemora et al. | 428/605 |
| 4,820,141 | 4/1989 | Shingu et al. | 419/8 |

FOREIGN PATENT DOCUMENTS 62-267013 11/1987 Japan .

OTHER PUBLICATIONS

"Physica B C", vol. 139/140, issued in 1989 in Netherland.

"Material Science and Engineering", vol. 46, No. 2, issued in 1989 in Netherland.

"Rapidly Solidified Crystal Alloys", issued in 1985 in U.S.A.

*Primary Examiner*—Stephen J. Lechert, Jr.

*Assistant Examiner*—Nina Bhat

*Attorney, Agent, or Firm*—Cushman, Darby & Cushman

[57] ABSTRACT

A method of producing a compact of amorphous alloy, comprising the steps of, preparing a billet by filling a container made of a ductile metal with powder of the amorphous alloy, plastically working said billet at a temperature higher than plasticity transition temperature of the amorphous alloy but less than crystallization temperature of said alloy so that both a shear strain of not less than about 0.7 but less than 1.8 and a stress not less than about 90 Kgf/mm$^2$ and less than 400 Kgf/mm$^2$ are applied to the amorphous alloy powder filled in the container.

9 Claims, 4 Drawing Sheets

METHOD OF PRODUCING A COMPACT OF AMORPHOUS ALLOYS

BACKGROUND OF THE INVENTION

This invention relates to a method of producing a compact of amorphous alloy by using powders of amorphous alloy, which compact is advantageously applicable to various kind of magnetic materials.

Regarding a conventional warm extrusion compacting method there is, for example, an invention disclosed in the U.S. Pat. No. 4,377,622. According to this prior art method, filament of amorphous alloy is filled in a metal container in a density of 50 to 60% of the theoretical density thereof, then the container being sealed by a plug so as to be used as a billet to be subjected to extrusion, next the thus prepared billet being heated to a substantially uniform working temperature between plasticity transition temperature and crystallization temperature of the alloy, subsequently the billet being subjected to warm extrusion working with a reduction of area of at least 3.5 to 1 (about 70%) to obtain a columnar compact of amorphous alloy. Disclosed further as another example is a method in which a core member is placed concentrically in a central part of a container and the filament of amorphous alloy is filled in a space defined between the core member and the inner wall of the container, then the container together with the filaments, after it has been sealed by a plug member, being extruded in a similar manner at a working temperature between plasticity transition temperature and crystallization temperature of the alloy, next the core member in the extruded billet being removed by machining to thereby obtain an aimed amorphous alloy compact of cylindrical shape.

However, any detailed conditions of the compacting had not been given by the patent. Since the prior art extrusion method described above utilizes tangled loose agglomeration of filaments, there has been such a problem that it is considerably difficult to uniformly fill such tangled loose filaments into a container. Moreover, since the method has also required to perform preliminary filling in order to obtain an initial filling density of 50 to 60%, there remained such an additional problem that there was a difficulty in filling the filaments into a container of complicated shape In addition, since the conventional extrusion technique requires at least about 70% reduction of area of the billet regarding extrusion working, considerably high extrusion load must be imparted to the billet during working, and this makes it necessary to use a large equipment.

Moreover, due to the fact that the billet must be subjected to a working of at least 70% in reduction of area, a large amount of heat occurs during the compacting working. In order to prevent the temperature rise from becoming no less than the crystallization temperature of the alloy, the temperature for the compacting had been restricted to a narrow range with the result that there was a serious problem in practical operation.

OBJECT OF THE INVENTION

The object of the invention is to eliminate the drawbacks in the prior art method by providing a method of producing amorphous compact from amorphous alloy powder in which method there are specified conditions necessary for forming an amorphous alloy compact having a density not less than 99% of the theoretical density value.

The method of the invention for producing an amorphous alloy compact, comprises the steps of: filling a container made of a ductile metal with powders of amorphous alloy to form a billet; plastically working the billet at a temperature not less than the plasticity transition temperature but less than the crystallization temperature of the amorphous alloy so that both a shear strain of not less than about 0.7 but less than 1.8 and a pressure not less than about 90 $Kgf/mm^2$ but less than 400 $Kgf/mm^2$ are applied to the amorphous alloy powder filled in the container.

According to the method of the invention, the amorphous alloy powder in the billet never crystallize and are firmly bonded together, with the result that a magnetic amorphous alloy compact having the density not less than 99% of theoretical density value is obtained.

In the invention, such an advantageous effect that a compact of amorphous alloy superior as a magnetic material can be readily obtained industrially from amorphous alloy powders.

DESCRIPTION OF THE PREFERRED EMBODIMENTS

Figure 1:
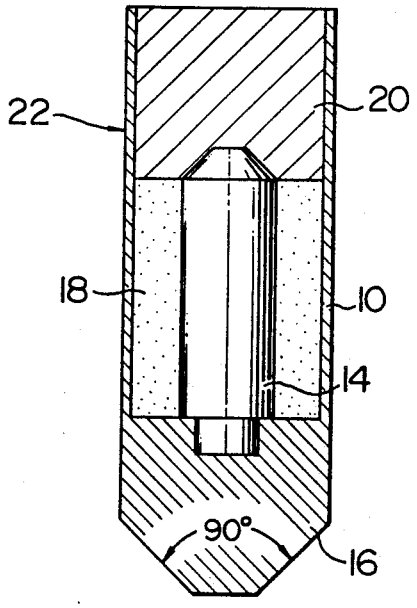
FIG. 1 is a cross sectional view of a billet to be compacted.

The preferred embodiments of the invention are described below by referring to the accompanying drawings.

(EXAMPLE 1)

There was prepared a cylindrical container 10 having an outside diameter of 29 mm and an inside diameter of 26 mm and made of a ductile alloy of AISI 1045. At the center of the container, a core member 14 made of AISI H 13 alloy having an outer diameter of 12 mm was concentrically placed and fixed thereto.

A head 16 provided at the end of the container 10 was mechanically worked to have a taper having an angle of 90°. Powders of amorphous alloy 18 (flaky powders having chemical composition represented by a formula $Fe_{78}B_{13}Si_9$ (at %) and having particle size of 54 to 105 μm) were filled into a space in the container 10 defined between the inner wall of the container and the core member 14 placed therein while applying vibration.

The density of the amorphous alloy after the filling, was about 50% of the value of theoretical density of the amorphous alloy.

After having finished the filling of the amorphous alloy 18, the filled container 10 was evacuated for 6 hours to have a pressure of $10^{-5}$ Torr, and argon gas was introduced therein. Immediately after the introduction of the argon gas, a plug 20 made of carbon steel (1045) was inserted to hermetically seal the container by use of a bonding agent of ceramic type to thereby prepare a billet 22.

Figure 2:
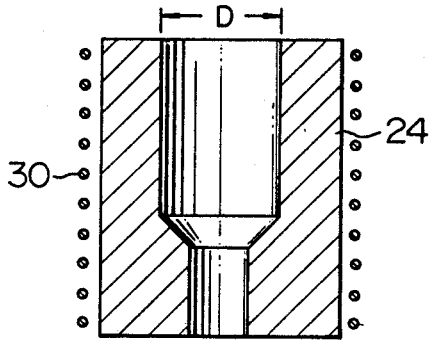
FIG. 2 being a cross sectional view of an extrusion die.
Figure 3:
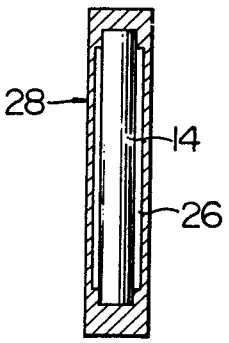
FIG. 3 being a cross sectional view of an amorphous alloy compact obtained by the invention, FIG. 4 being a cross sectional view of a test billet for measuring shear strain, FIG. 5(*a*) being a cross sectional view of the test billet after having been compacted, FIG. 5(*b*) being an enlarged cross sectional view of an encircled portion of the test billet in FIG. 5(*a*), and FIGS. 6(*a*) to 6(*d*) being photomicrographs showing the metal structure of the section of the amorphous alloy compact according to the present invention.

Next, graphite lubricant was applied to the surface of the billet 22, the billet being heated at the compacting temperature as shown in Table 1 and then being subjected to warm extrusion by use of an extrusion die 24 shown in FIG. 2 to thereby obtain an amorphous alloy compact 28 having an amorphous alloy layer 26 formed on the surface of the core 14 as shown in FIG. 3.

The rate of heating of the billet was maintained at about 12 K/min up to 250° C. and at about 3 K/min above 250° C. The extrusion die was previously heated at about 260° C.

The extrusion die was formed to perform a working of 40% in reduction of area and to have entry angle of 90°, an extrusion speed of the working being about 6 mm/sec. The inlet diameter of the extrusion die was almost the same as that of the outside diameter of the billet 22.

The amorphous alloy compact thus obtained was cut into pieces to investigate the density of the amorphous alloy layer, existence of any crack and the amount of amorphous alloy contained therein. The results thereof are shown in Table 1.

The amorphous alloy compact obtained in the Example was uniform in structure, as a whole, as shown in FIG. 6(*a*), having a high density of 99.8%. The X-ray diffraction analysis of an amorphous alloy region of the compact showed that the region was in a completely amorphous state.

Figure 4:
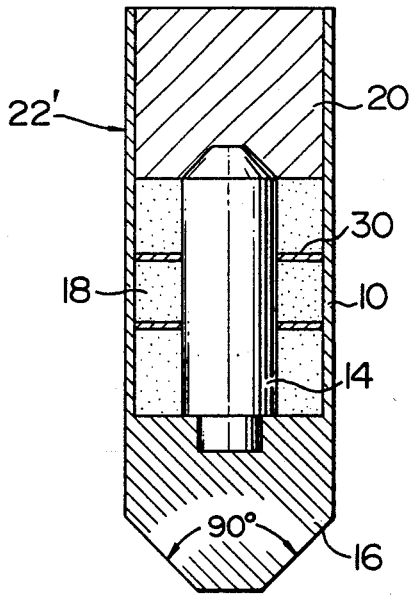
Figure 5A:
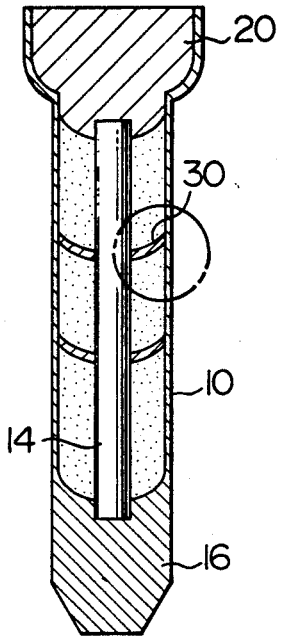
Figure 5B:
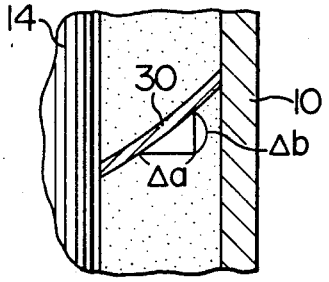
Figure 6A:
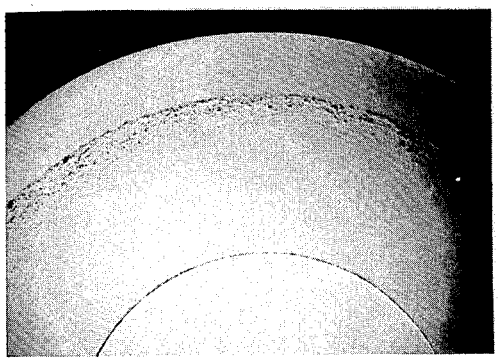
Figure 6B:
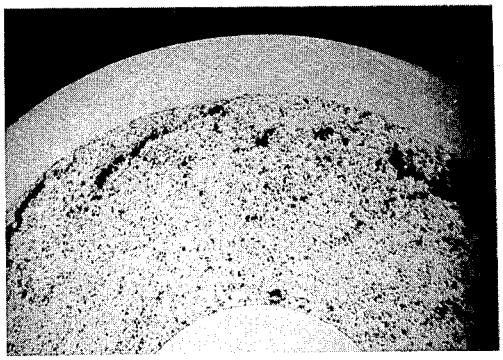
Figure 6C:
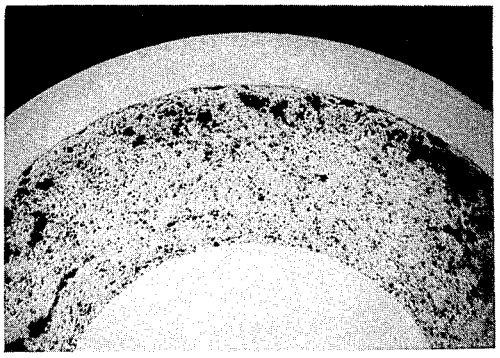
Figure 6D:
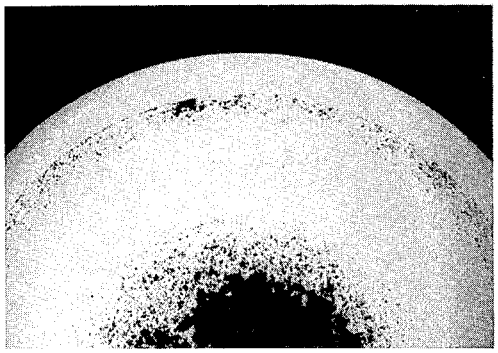

In order to measure the shear strain acting in the amorphous alloy portion of the compact under this condition, a billet 22' similar to the billet of the Example 1 was prepared as shown in FIG. 4, in which both a brass disc 30 having a thickness of 0.1 mm and an amorphous alloy layer 18 are disposed alternately. The billet 22' was subjected to extrusion compacting under the same manner and conditions as in the Example 1. After the extrusion compacting, the compacted billet 22' was cut into halves along its longitudinal axis, the cross section of which is shown in FIG. 5.

The shear strain was defined by the formula shown below, judging from the deformed brass discs 30 in the extruded test billet. The obtained shear strain acted on the amorphous alloy region during the extrusion is shown in Table 1.

$$\text{Shear Strain} = \Delta b/\Delta a$$

wherein:

$\Delta a$ is a unit length in radial direction of the billet after having been compacted, $\Delta b$ is a deformed length of the brass disc after compacting in the longitudinal direction of the billet.

Further, to measure hydrostatic stress applied to the amorphous alloy powder region, a strain gauge was attached to the punch of the extrusion press (not shown) to thereby measure an average stress applied to the punch during the compacting.

Assuming that this average stress was similarly applied to the amorphous alloy powder region, hydrostatic stress applied to the amorphous alloy powder region during the extrusion compacting was obtained, and the thus obtained result is shown in Table 1.

Explanation will now be made on comparison examples 1 and 2 for comparison. In the comparison example 1, a value of shear strain was reduced by using a core member 14 of a smaller diameter, while in the comparison example 2 a value of hydrostatic stress is reduce by using a core member 14 made of a material having a lower Rockwell hardness value (HRC).

(COMPARISON EXAMPLE 1)

In the comparison Example 1, a round bar of 8 mm in diameter made of AISI H13 alloy was used as a core member 14.

Extrusion in this comparison example was effected under the same manner and conditions as those in the Example 1 with the exception of the core member shown above.

The amorphous alloy region in a resultant compact was proved to be fairly porous, as shown in FIG. 6(*b*), and it was not able to obtain a satisfactory compact in the comparison example 1.

The X-ray diffraction analysis of the amorphous alloy region thereof showed that the region was in a completely amorphous state.

Both shear strain and hydrostatic stress having acted on the amorphous alloy region were also measured in this comparison example 1, the measured shear stress was a low value of 0.65 as shown in Table 1.

(COMPARISON EXAMPLE 2)

In the comparison Example 2, a round bar having a diameter of 12 mm made of 0.45 carbon steel in a quenched and tempered state (AISI: 1045) was used as a core member 14. Extrusion in the comparison example 2 was effected under the same manner and conditions as those in the Example 1 with the exception of the core member. The amorphous alloy region in a resultant compact was proved to be fairly porous as a whole as in the comparison example 1, as shown in FIG. 6(*c*). The X-ray diffraction analysis was also made regarding the amorphous alloy region thereof, with the result that the region was in a fully amorphous state. Both shear strain and hydrostatic stress acted on the amorphous alloy region were also measured in the comparison example 2, which hydrostatic stress showed a low value of 84 $Kgf/mm^2$ as shown in Table 1.

Explanation will now be made on the Example 2 which utilizes cobalt based amorphous alloy.

(EXAMPLE 2)

In this Example 2, a cobalt based amorphous alloy (its composition is expressed by: $Co_{69}Fe_4Ni_1Mo_2B_{12}Si_{12}$ and its particle diameter of 54 to 105 $\mu m$) was used, and a billet 22 to be compacted was prepared in the same manner as in the Example 1. The billet 22 was compacted by extrusion at a working temperature of 425° C. under the same compacting conditions as in the Example 1 with the exception of the powder composition and the compacting temperature shown above.

An amorphous alloy region in a compact obtained by the Example 2 was proved to be uniform and high density (99.6%).

The X-ray diffraction analysis of the amorphous alloy region showed that the region was in a fully amorphous state.

Both shear strain and hydrostatic stress applied to the amorphous alloy region in the Example 2 was measured as in Example 1, and the result is shown in Table 1.

(COMPARISON EXAMPLE 3)

In the Comparison Example 3, a billet 22 was prepared by the same way as in the Example 1. After having been previously heated to 450° C., the billet 22 was compacted by extrusion under the same compacting conditions as in the Example 1 with the exception of the temperature shown above.

Although a resultant compact was uniform and had a high density (99.8%) similarly to those of the Example 1, the X-ray diffraction analysis of the amorphous alloy region showed that the region had already crystallized, and this is considered to be attributable to the fact that the temperature of the powders rose to a value more than the crystallization temperature thereof due to heat occurring during the extrusion compacting. Next, Comparison Example 4 will be explained hereunder where no core member was placed in the container 10.

(COMPARISON EXAMPLE 4)

A container 10 having an outside diameter of 29 mm and an inside diameter of 26 mm and made of AISI 1045 alloy was filled with flaky amorphous powders of $Fe_{78}B_{13}Si_9$ by repeating a loading of the powders of 5 gram per each loading while applying cold compression during each loading.

The filling ratio was about 62% of the theoretical density.

The filled container 10 was evacuated for 6 hours down to a pressure of $10^{-5}$ Torr, then it was filled with argon gas. Immediately after the filling, a plug 20 made of carbon steel (1045) and coated with ceramic type bonding agent was inserted to hermetically seal the container, thus a billet 22 being prepared.

Next, a suitable lubricant was applied to the surface of the billet 22, the billet being heated to a compacting temperature of 325° C., and then the billet was warm-extruded by use of an extrusion device previously heated to about 260° C.

The rate of heating of the billet 22 was maintained at about 12 K/min up to 250° C. and at about 3 K/min above 250° C.

The inlet diameter of the extrusion die was almost the same as that of the billet. The reduction of area of the compacting was 60%, an angle of the terminal end of the head 16 being 90°, and extrusion speed being about 6 mm/sec.

The compacted billet was air-cooled.

In the amorphous alloy compact thus obtained, although the outer peripheral portion of the amorphous alloy portion was integrated with a high density, its central portion was poorly bonded as shown in FIG. 6(*d*), so that the portion was peeled off when the compact was subjected to cutting and polishing.

X-ray diffraction analysis of the amorphous region of the compact showed that the region was maintained at a completely amorphous state.

In order to measure a value of shear strain acting on the amorphous alloy portion of the compact obtained in this comparison example, another billet was prepared in which brass plates and amorphous alloy powder were placed alternately in the same manner as in the Example 1, the extrusion thereof being conducted in the same manner as in this comparison example 4, and values of the shear strain measured therefrom are shown in Table 1.

A shear strain measured at the alloy region of the comparison test 4 where the bonding of the powders was not sufficient were in a range of 0 to 0.58, while another shear strain of the outer region where the bonding was satisfactory were in a range of 0.58 to 1.19.

The value of hydrostatic stress applied to the amorphous alloy powder region was measured by the same way as in the Example 1, which value is shown in Table 1.

Judging from these examples shown above, it was confirmed that satisfactory amorphous alloy compact having a density not less than 99% and a degree of amorphous property (X-ray diffraction) of 100% can be obtained, provided that two conditions, that is, both the shear strain of not less than 0.7 and hydrostatic stress of not less 90 Kgf/mmz are satisfied.

Regarding practical ranges of these two conditions, the shear strain may be preferably less than 1.8, while the hydrostatic stress, by taking the strength of the extrusion die 24 into account, may be preferably 400 $Kgf/mm^2$.

It will be understood from the comparison example 4 that no good amorphous compact can be obtained unless a core member is used. That is, even if both high reduction of area and a high rate of initial filling are applied to the billet, a value of shear strain occurring in the center portion of the billet becomes less than 0.7 so that no good compact can be obtained.

The reduction of area in the amorphous portion given in the above mentioned data is obtained from the following formula.

$$\frac{(A^2 - B^2) - (C^2 - D^2)}{(A^2 - B^2)}$$

where:

A is an inner diameter of the container before extrusion,

B is an outer diameter of the core before extrusion,

C is an inner diameter of the container after extrusion, and

D is an inner diameter of the core after extrusion.

| | Condition of Compacting | | | | | | | | Results | | | |
|---|---|---|---|---|---|---|---|---|---|---|---|---|
| Example | Powder composition (at %) | Reduction of Area of Die | Compacting Tem. (°C.) | Kind of Core Mat | Core Diameter (mm) | Particle Dia. (μm) | Initial Ratio of Filling (%) | Reduction of Area of the Amorphous Alloy Portion (%) | Shear Strain | Hydrostatic Stress ($Kgf/mm^2$) | Amorphous or not | Actual Density compared with theoretical density (%) |
| 1 | $Fe_{78}B_{13}Si_9$ | 40 | 400 | H13 QT | 12 | 53~105 | 50 | 56 | 0.75 | 106 | YES | 99.8 |
| Comparison 1 | " | " | " | H13 QT | 8 | " | " | 52 | 0.65 | 106 | YES | <<99 |
| Compari- | " | " | " | 1045 | 12 | " | " | 56 | 0.84 | 84 | YES | <<99 |

-continued

| Example | Condition of Compacting: Powder composition (at %) | Reduction of Area of Die | Compacting Tem. (°C.) | Kind of Core Mat | Core Diameter (mm) | Particle Dia. (μm) | Initial Ratio of Filling (%) | Reduction of Area of the Amorphous Alloy Portion (%) | Results: Shear Strain | Hydrostatic Stress (Kgf/mm²) | Amorphous or not | Actual Density compared with theoretical density (%) |
|---|---|---|---|---|---|---|---|---|---|---|---|---|
| son 2 | | | | QT | | | | | | | | |
| 2 | $Co_{69}Fe_4Ni_1Mo_2B_{12}Si_{12}$ | " | 425 | H13 QT | 12 | " | " | 58 | 0.76 | 104 | YES | 99.6 |
| Comparison 3 | $Fe_{78}B_{13}Si_9$ | " | 450 | H13 QT | 12 | " | " | 57 | — | — | Crystallized | 99.8 |
| Comparison 4 | " | 60 | 325 | | | 54~105 | 62 | 62 | *1 0~0.58 *2 0.58~1.19 | 151 | | *1 — *2 99.0 |

*1: Unjoined portion of the powders
*2: Joined portion

What is claimed is:

1. A method of producing a compact of amorphous alloy, comprising the steps of: preparing a billet by filling a container made of a ductile metal with powder of the amorphous alloy; working plastically the billet at a temperature higher than plasticity transition temperature of the amorphous alloy but less than the crystallization temperature of said amorphous alloy so that both a shear strain of not less than about 0.7 but less than 1.8 and a stress not less than about 90 Kgf/mm² but less than 400 Kgf/mm² are applied to the amorphous alloy powder filled in the container.

2. A method of producing a compact of amorphous alloy as claimed in claim 1, wherein the plastical working is extrusion working in which reduction of area of the whole of the billet is not more than 60% and in which another reduction of area at a portion filled with said amorphous alloy is kept within a range of 50% to 70%.

3. A method of producing a compact of amorphous alloy as claimed in claim 1, wherein the billet has a core member having both a predetermined strength and a predetermined diameter which core member is fixed to a center portion of the billet to thereby provide a space defined between the container and the core member, said space being filled with the powder of amorphous alloy.

4. A method of producing a compact of amorphous alloy as claimed in claim 3, wherein said core member has a hardness and diameter so that both a shear strain of not less than about 0.7 but less than 1.8 and a pressure of not less than about 90 Kgf/mm² but less than 400 Kgf/mm² are applied to the amorphous alloy powder in the billet during the working.

5. A method of producing a compact of amorphous alloy as claimed in claim 1, wherein said billet is prepared by merely applying vibration to the powders of amorphous alloy filled in said metallic container.

6. A method of producing a compact of amorphous alloy as claimed in claim 1, wherein said compact of amorphous alloy has a density not less than 99% of the theoretical density value of said amorphous alloy.

7. A method of producing a compact of amorphous alloy as claimed in claim 1, wherein said compact of amorphous alloy has a fully amorphous state confirmed by X-ray diffraction analysis.

8. A method of producing a compact of amorphous alloy as claimed in claim 1, wherein the chemical composition of said amorphous alloy powders is one selected from the group consisting of Fe-based alloy and Co-based alloy having superior properties as a magnetic material.

9. A method of producing a compact of amorphous alloy as claimed in claim 1, wherein particle size of said amorphous alloy powder is less than 200 μm.

* * * * *